United States Patent [19]

Trost

[11] 4,022,253

[45] May 10, 1977

[54] RAPIERS WITH MEANS FOR LIMITING RAPIER HEAD DIVERGENCE DURING WEFT-YARN TRANSFER

[75] Inventor: Wayne C. Trost, Rockford, Ill.

[73] Assignee: Barber-Colman Company, Rockford, Ill.

[22] Filed: May 14, 1976

[21] Appl. No.: 686,652

[52] U.S. Cl. ..... 139/446; 139/448
[51] Int. Cl.[2] ..... D03D 47/20
[58] Field of Search ..... 139/443–448

[56] References Cited

UNITED STATES PATENTS

| | | | |
|---|---|---|---|
| 3,602,266 | 8/1971 | Duplessy | 139/448 |
| 3,895,656 | 7/1975 | Allsopp | 139/446 |

*Primary Examiner*—Henry S. Jaudon
*Attorney, Agent, or Firm*—Robert M. Hammes, Jr.

[57] ABSTRACT

A rapier of a weft inserting mechanism in a vertical weaving machine has an associated guide for engaging a cooperating rapier to prevent substantial divergence of the rapiers when they come together so as to facilitate transfer of the weft yarn from one rapier to the other during weft yarn insertion.

13 Claims, 9 Drawing Figures

RAPIERS WITH MEANS FOR LIMITING RAPIER HEAD DIVERGENCE DURING WEFT-YARN TRANSFER

BACKGROUND OF THE INVENTION

This invention relates to the weft inserting mechanism of a vertical weaving machine. In particular, the invention concerns limiting the divergence of the weft-yarn-carrying heads of the entry and exit rapiers when they come together for yarn transfer during the weft insertion operation.

The rapiers in a weaving machine are typically composed of an elongated tubular section having a thread carrying head which travels into and out of the warp shed during the weft inserting operation. Depending on the amount of support provided along the length of the rapier, the rapier head experiences varying degrees of random movements in combinations of horizontal and vertical directions transverse to the longitudinal movement of the rapier while the rapier is traveling in the warp shed. In standard looms having a generally horizontal configuration the rapiers are supported along their entire length during the weft inserting operation since they rest on a warp sheet supported by the lay of the machine while traveling in the shed. The situation is considerably different in weaving machines having a vertical configuration such as those currently being developed for weaving triaxial fabric of the type disclosed in U.S. Reissue Pat. No. Re. 28,155 and U.S. Pat. No. 3,874,422 both issued to Norris F. Dow. Weaving machines constructed with a vertical configuration do not readily lend themselves to providing mechanical supports for the rapiers as is done in standard horizontal looms. In vertical weaving machines the rapiers are cantilevered in such fashion that the weft carrying head is susceptible to random transverse movement while traveling in the shed. In order to attain successful transfer of the weft yarn from the entry rapier to the exit rapier it is essential that the rapiers come precisely together. The inherent instability of the cantilevered rapiers can result in misalignment of the rapiers at the weft transfer point and consequently the exit rapier fails to grip the weft yarn. This results in a flaw in the fabric. When there is a missed transfer the machine is stopped by a stop motion device and the weft yarn must then be inserted manually. To obtain high efficiency the number of stops must be minimized.

In order to insure that the rapier heads are properly aligned for transfer it is necessary to limit the divergence of the heads when they come together. One way to limit divergence is to provide for stabilization of the rapiers while they travel in the shed. My copending application Ser. No. 686,651 filed May 14, 1976 of common ownership herewith, describes apparatus which utilize the warp shed sheets to provide stabilization. The instant invention provides an alternative way to limit the divergence and obtain proper alignment of the rapier heads when they come together for transfer.

SUMMARY OF THE INVENTION

The rapiers of a vertical weaving machine travel weftwise in a horizontal plane during weft insertion. Random lateral movement of the rapier heads may cause misalignment at the transfer point and consequent transfer failure. In several embodiments the invention disclosed herein provides means associated with one of the rapiers to limit the divergence of the rapier heads at the point of weft yarn transfer and thereby insure that the yarn is successfully transferred from the entry rapier to the exit rapier. In other embodiments the limiting means comprises a receiving means associated with one rapier for receiving a corresponding entry means associated with the other rapier. The apparatus disclosed herein provide structurally simple and inexpensive means for insuring proper alignment of the rapier heads at the transfer point. The invention greatly reduces the number of machine stops and thus an overall increase in weaving efficiency is obtained.

Other features and advantages will become apparent from the following detailed description of the invention taken in conjunction with the accompanying drawings.

DESCRIPTION OF THE INVENTION

In a typical vertical machine for weaving fabric, warp strands are guided by opposed sets of a plurality of elongated heddles spaced laterally weft-wise in the machine. The heddles are positioned longitudinally by a shedding means so as to arrange the warp strands into sheets with form warp sheds. The operation and construction of a suitable shedding means is described in a copending application, Ser. No. 687,012 filed May 17, 1976 which is of common ownership with this application. Said copending application is hereby incorporated by reference to explain in detail the shed forming operation.

Figure 1:
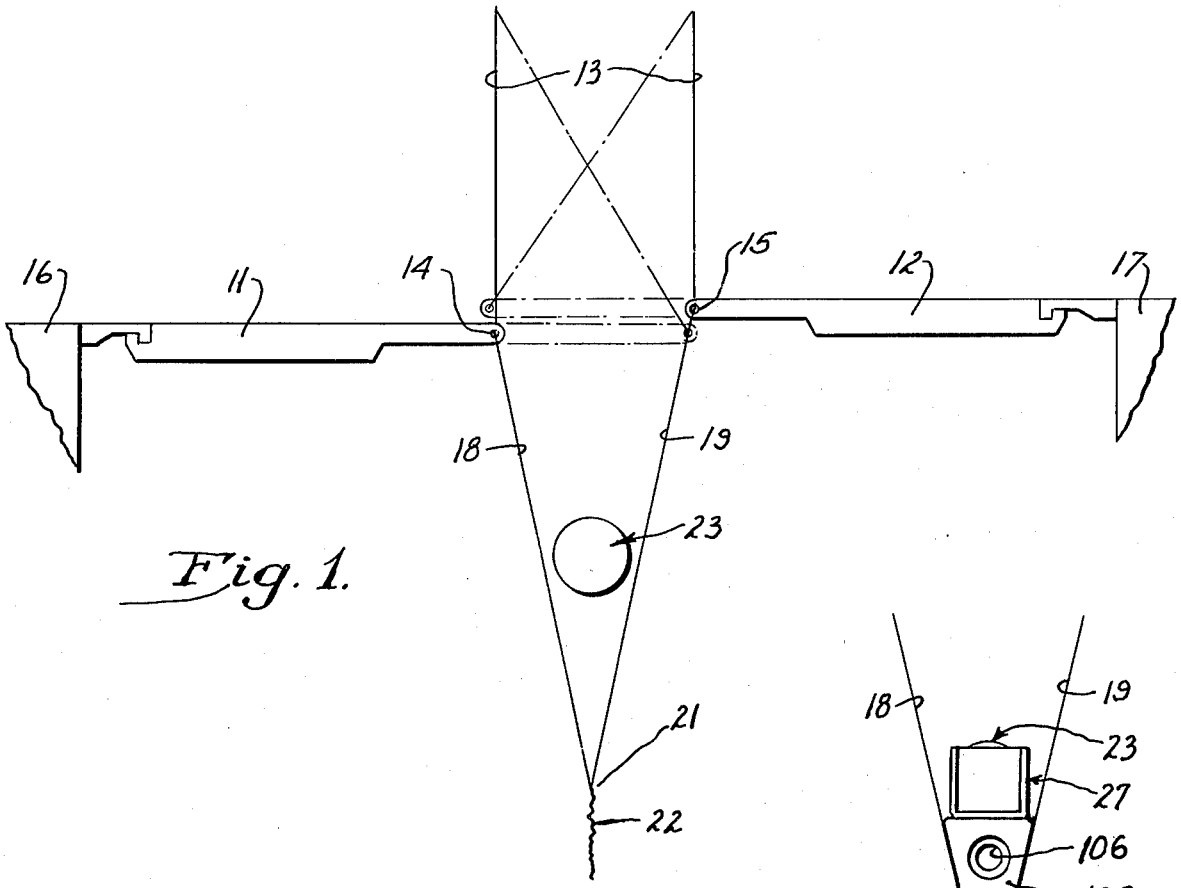
FIG. 1 is a partial end view of a weaving machine showing a warp shed and a weft yarn carrying rapier with guide means in the shed.
Figure 2:
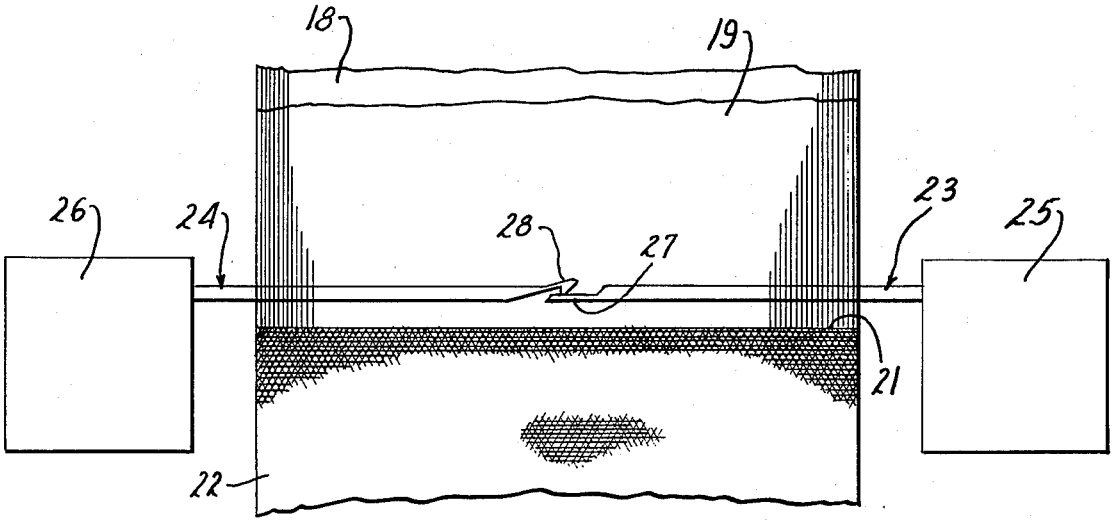
FIG. 2 is a front view, partially broken away, schematically showing the weft yarn insertion apparatus of a triaxial weaving machine.

Referring now to FIG. 1, two sets of opposing heddles 11, 12 have warp strands 13 running through closed eyes 14, 15. Shedding means 16, 17 selectively position the heddles in either retracted (shown by solid lines) or extended (shown by phantom lines) positions to form the sheds into which weft yarns are inserted during weaving of fabric. The opposing sheets 18, 19 of warp strands come together at the fell line 21 of the woven fabric 22. When a shed is formed a weft yarn (not shown) is inserted into the shed by a weft-wise travelling entry rapier 23. In the shed, as shown in FIG. 2, the weft yarn is transferred to exit rapier 24 and is pulled through the shed as rapiers 23, 24 are retracted from the shed. After insertion the weft-yarn is beaten down to the fell line 21 by a suitable beater mechanism (not shown). Heddles 11, 12 are then repositioned by shedding means 16, 17 to form another shed and the weft insertion process is repeated.

FIG. 2 shows the warp strand sheets 18, 19 which come together at the fell line 21 of the woven fabric 22. Entry rapier 23 and exit rapier 24 are shown inserted to the point of weft-yarn transfer in the shed. Rapier inserting means 25, 26 control the insertion and retraction of entry rapier 23 and exit rapier 24 respectively. As is apparent from FIG. 2, rapiers 23, 24 are supported in cantilever fashion by rapier inserting means 25, 26. Due to this cantilevered construction the weft-carrying rapier heads 27, 28 of rapiers 23, 24 experience varying degrees of random transverse movement while travelling into and out of the shed. This instability can cause misalignment of entry rapier 23 and exit rapier 24 when they come together for transfer of the weft yarn. The result may be a missed transfer or possibly a collision of rapiers 23, 24.

A typical rapier is comprised of an elongated body portion having any of several cross-sections. The shed-penetrating fore-end of the rapier generally has an associated weft-yarn carrying rapier head which may be either an integral part of the body portion or a distinct element fixed thereto. While the rapiers described herein have a tubular body and a rapier head which is inserted in the tube, it should be understood that the invention also applies to elongated rapiers of other constructions which may be susceptible to random transverse movement while travelling in the shed.

Figure 3:
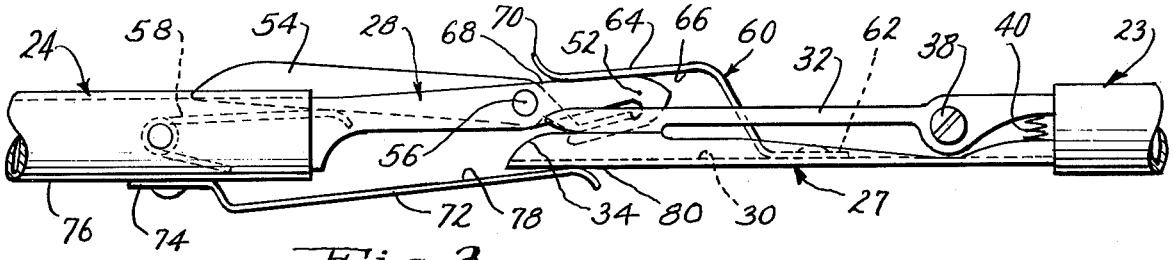
FIG. 3 is a side view of entry and exit rapiers, in the weft transfer position, with clip means.
Figure 4:
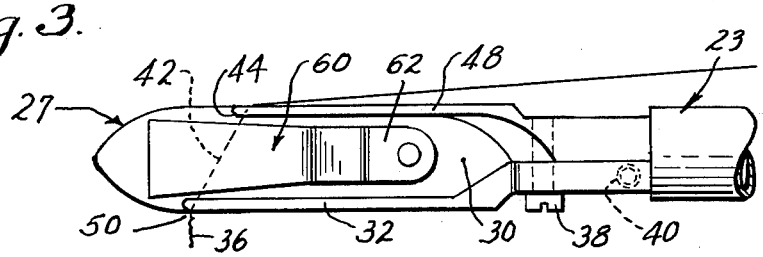
FIG. 4 is a top view of the entry rapier of FIG. 3.
Figure 5:
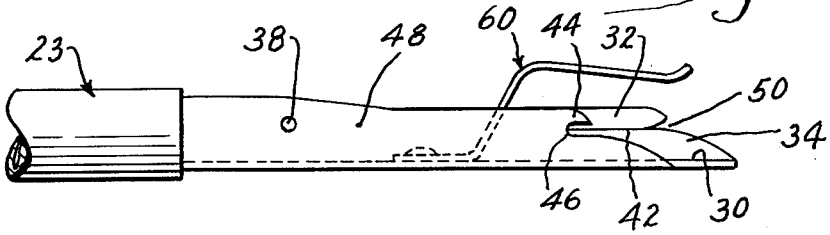
FIG. 5 is a side view, opposite to that shown in FIG. 3 of the entry rapier.

In order to insure successful transfer of the weft yarn from the entry rapier to the exit rapier, one rapier is provided with means to receive the other rapier so as to limit the divergence of the rapiers when they come together for weft yarn transfer. Referring to FIGS. 3 and 4, entry rapier 23 is provided with a yarn gripping mechanism spaced above the floor 30 of rapier head 27 comprised of a spring biased moving branch 32 and a stationary branch 34 which grips the weft yarn 36. Moving branch 32 is shown as pivoted at 38 and biased by spring 40. As best seen in FIG. 4, weft yarn 36 is drawn across rapier head 27 so that a section 42 of weft yarn 36 lies between the gripping mechanism and a yarn guide 44. Yarn guide 44 is best seen in FIG. 5. Notch 46 is located at the fore-end of wall 48 to provide means for retaining a weft yarn in proper position during transfer. The notch 46 is preferably displaced above floor 30 approximately the same distance as the gripping point 50 established by moving branch 32 and stationary branch 34. When rapiers 23, 24 come together for transfer, as shown in Fig. 3, the hook 52 of exit rapier head 28 travels over yarn section 42 between gripping point 50 and notch 46 (FIGS. 4 and 5) so that hook 52 grips the weft yarn when the rapiers 23, 24 withdraw from the shed. A suitable yarn gripping mechanism for exit rapier 24 comprises hook 52 and moving branch 54 pivoted at 56. Moving branch 54 is biased by spring 58. In some cases, due to vertical misalignment of rapiers 23, 24 hook 52 may bounce upward off of the floor 30 of rapier head 27. If rapier 24 is withdrawn before hook 52 returns to the normal transfer position hook 52 will fail to catch the warp yarn. In order to limit vertical divergence of rapier heads 27, 28 a suitable retaining means, which may be a member spaced substantially vertically from one of the rapier heads, is provided which keeps the heads in proximity to each other when they come together. In the embodiment shown, clip 60, which can be resilient or rigid, has a base 62 which is mounted on the floor 30 of rapier head 27. Clip 60 has a substantially horizontal section 64 disposed above floor 30 at the front end of entry rapier head 27. The bottom surface 66 of section 64 contacts the top surface 68 of exit rapier head 28 when rapier heads 27, 28 come together so that proper vertical alignment is maintained during weft yarn transfer. The front end 70 of section 64 is preferably turned up to form a sloping surface to assist in guiding rapier head 28 into proper alignment with rapier head 27 and to avoid a head-on collision between clip 60 and rapier head 28.

This limitation on vertical divergence can also be obtained by providing exit rapier 24 with a clip 72 having a base 74 attached to the bottom 76 of rapier 24. The top surface 78 of clip 72 contacts the bottom surface 80 of entry rapier head 27 when the rapier heads 27, 28 come together thereby maintaining proper vertical alignment during weft yarn transfer.

Figure 6:
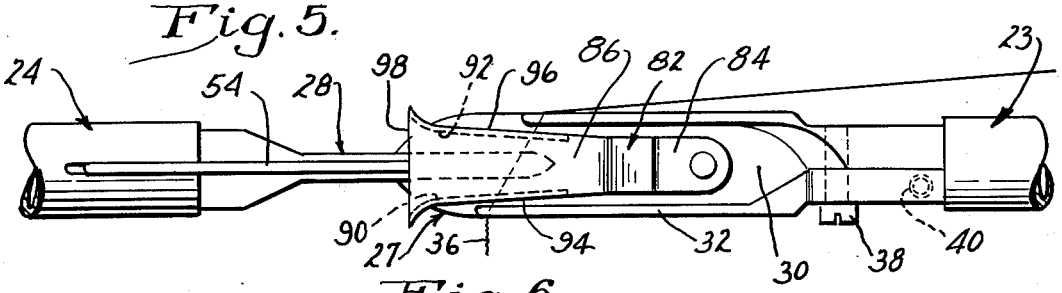
FIG. 6 is a top view of entry and exit rapiers, in the weft transfer position, showing another embodiment of the clip means.
Figure 7:
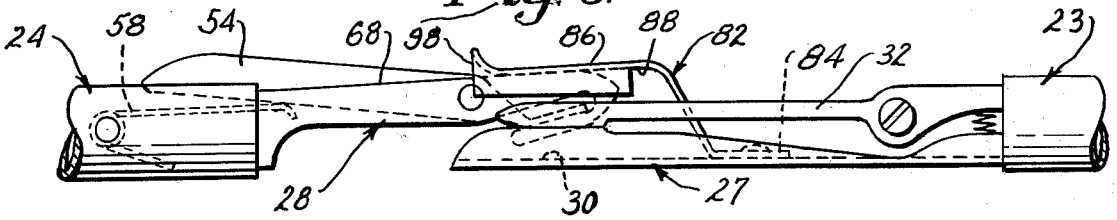
FIG. 7 is a side view of the rapiers of FIG. 6.

It is possible that horizontal movements of the rapier heads 27, 28 may result in misalignment at the transfer point sufficient to cause a missed yarn transfer. The embodiment shown in FIGS. 6 and 7 provide a way to insure proper horizontal alignment. The rapiers shown are the same as those previously described, except for some clip modifications, and like parts are identified with like numbers. Clip 82, which can be resilient or rigid, has a base 84 which is mounted on the floor 30 of rapier head 27. Clip 82 has a substantially horizontal section 86 disposed above the floor 30 at the front end of rapier head 27. The bottom surface 88 of section 86 contacts the top surface 68 of exit rapier head 28 when rapier heads 27, 28 come together thereby insuring that the vertical proximity of the rapier heads 27, 28 is sufficient to achieve weft yarn transfer. In order to provide proper horizontal alignment, section 86 is provided with walls 90, 92 which preferably extend substantially vertically downward from the lateral or outside edges 94, 96 of section 86. The front end 98 of clip 82 is preferably flared outwardly from the axis of rapier 23 to form a sloping surface. This will allow exit rapier head 28 to be guided under section 86 and between walls 90, 92 and thereby attain proper alignment for transfer. Thus, rapier head 28 is essentially entering into an enclosure formed by section 86, walls 90, 92 and floor 30 which limits divergence in both horizontal and vertical directions.

Figure 9:
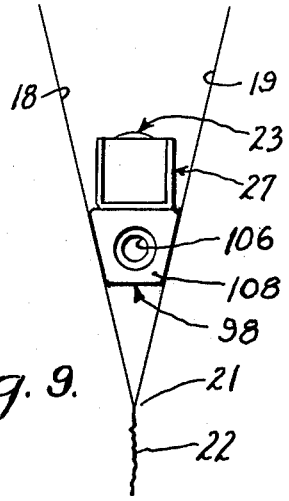
FIG. 9 is an end view of the entry rapier of FIG. 8 in the warp shed.
Figure 8:
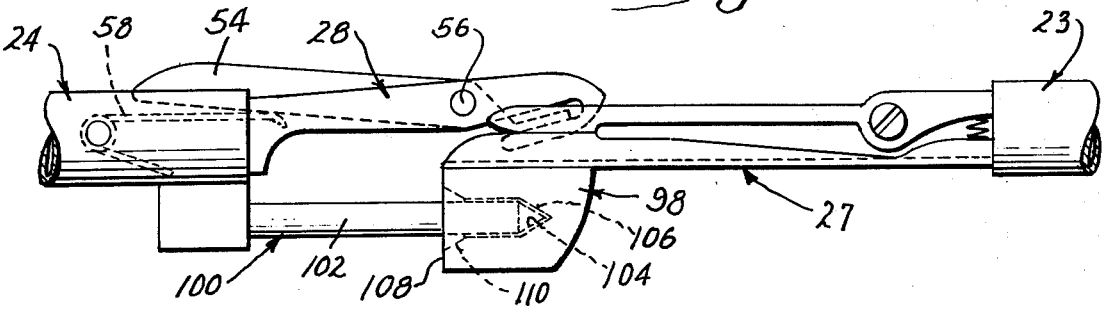
FIG. 8 is a side view of entry and exit rapiers, in the weft transfer position, having receiving and entry means respectively.

Another embodiment of the invention is shown in FIGS. 8 and 9. Entry rapier 23 is provided with a receiving member 98 associated with, and disposed below, the fore-end of rapier head 27. Exit rapier 24 is provided with a suitable entry means such as prong 100 which is shown as being associated with the fore-end of rapier 24 and disposed below exit rapier head 28. Prong 100 has a substantially horizontal section 102 which tapers to a point at its front end 104. Receiving member 98 has an opening such as a hole 106 in its face 108 which extends substantially horizontally into receiving member 98. Prong 100 and receiving member 98 are so constructed that point 104 enters hole 106 when the rapiers 23, 24 come together for weft yarn transfer and thus limit divergence of rapier heads 27, 28. The tapered front end 104 of prong 100 allows Section 102 to be guided into hole 106 in the event misalignment exists when the rapiers 23, 24 come together. Further, hole 106 is preferably flared as shown at 110 to provide additional guiding. Hole 106 and prong 100 are shown as having circular cross-sections but any suitable shape can be employed. Also, as best seen in Fig. 9, the dimensions of receiving member 98 is limited by the shed formed by warp strand sheets 18, 19. Member 98 must be so constructed that it does not interfere with warp sheets 18, 19.

It will be readily apparent to those skilled in the art that many modifications and variations of the invention disclosed herein can be employed without departing from the scope and spirit of the invention. For example, other arrangements of receiving and entry means are possible which employ the principle of the embodiment shown in FIGS. 8 and 9, namely an element of one rapier entering an element of the other rapier so as to limit both horizontal and vertical divergence. The entry means could be associated with the entry rapier and the receiving means associated with the exit rapier. These elements could be disposed above the heads of the rapiers. The head of one of the rapiers could be the entry means as, for example, in the embodiment shown in FIGS. 6 and 7. Variations employing the principle of the embodiment shown in FIGS. 3, 4, and 5 are also possible. For example, the rapier head or the rapier tube could be so constructed that a limiting device functioning according to the disclosed principal is integral with the head or tube. Consequently, the invention is not limited to the specific embodiments disclosed herein but rather, is limited only by the claims.

I claim:

1. In a weft inserting mechanism of a vertical weaving machine having a pair of reciprocating opposed cantilevered rapiers for inserting weft strands into warp sheets by transferring an end of a weft strand from the shed-penetrating end of a entry rapier to the shed-penetrating end of an exit rapier in said warp sheds, a rapier comprising an elongated member, a shed-penetrating fore-end on said member, said fore-end comprising guide means for receiving and guiding a portion of the other of said rapiers, said guide means having a sloping frontal surface adapted to engage a portion of the other of said rapiers to correct misalignment of the rapiers, whereby said guide means limits divergence of said shed-penetrating ends as they come together for weft strand transfer.

2. A rapier according to claim 1 wherein said guide means comprises entry means adapted to be received by a portion of the other of said rapiers.

3. A rapier according to claim 1 wherein guide means comprises a receiving member disposed below a portion of said rapier, said receiving member having an opening for receiving a portion of the other of said rapiers.

4. A rapier according to claim 3 wherein said sloping frontal surface comprises the flared end of said opening.

5. A rapier according to claim 1 wherein said guide means comprises a retaining member spaced substantially vertically from a portion of said rapier to permit entry of a portion of the other of said rapiers between said retaining member and said rapier portion.

6. A rapier according to claim 5 wherein a portion of said retaining member is disposed above said rapier portion.

7. A rapier according to claim 5 wherein a portion of said retaining member is disposed below said rapier portion.

8. A rapier according to claim 5 wherein said retaining member has a lateral edge and a substantially vertical section extending from said lateral edge toward said rapier portion.

9. A rapier according to claim 5 wherein said sloping frontal surface comprises a front portion of said retaining member which is flared outwardly from the axis of said rapier.

10. A rapier according to claim 5 wherein said retaining member comprises a resilient clip.

11. A rapier according to claim 5 wherein said retaining member is attached to said elongated member.

12. A rapier according to claim 5 wherein said fore-end additionally comprises a rapier head and said retaining member is attached to said rapier head.

13. A rapier according to claim 12 wherein said sloping frontal portion has a conical shape.

* * * * *